US011554935B2

(12) United States Patent
Hugel

(10) Patent No.: US 11,554,935 B2
(45) Date of Patent: Jan. 17, 2023

(54) ELEVATOR CAR

(71) Applicant: Inventio AG, Hergiswil (CH)

(72) Inventor: Stefan Hugel, Bridgewater, NJ (US)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 17/309,066

(22) PCT Filed: Nov. 18, 2019

(86) PCT No.: PCT/EP2019/081660
§ 371 (c)(1),
(2) Date: Apr. 20, 2021

(87) PCT Pub. No.: WO2020/104378
PCT Pub. Date: May 28, 2020

(65) Prior Publication Data

US 2022/0009744 A1 Jan. 13, 2022

(30) Foreign Application Priority Data

Nov. 19, 2018 (EP) ..... 18207057

(51) Int. Cl.
*B66B 5/00* (2006.01)
*B66B 11/02* (2006.01)

(52) U.S. Cl.
CPC ..... *B66B 5/0081* (2013.01); *B66B 11/0226* (2013.01)

(58) Field of Classification Search
CPC . B66B 5/0081; B66B 11/0226; E04F 11/1812
See application file for complete search history.

(56) References Cited

U.S. PATENT DOCUMENTS 3,020,023 A * 2/1962 MacIntyre ..... E01F 13/022 256/25
3,841,609 A * 10/1974 Smith ..... E04G 21/3242 256/65.14
6,015,139 A * 1/2000 Weber ..... E04H 12/2261 52/298

(Continued)

FOREIGN PATENT DOCUMENTS

AU 1741999 A 9/1999
CN 1436147 A 8/2003

(Continued)

*Primary Examiner* — Michael A Riegelman
(74) *Attorney, Agent, or Firm* — William J. Clemens; Shumaker, Loop & Kendrick, LLP

(57) ABSTRACT

An elevator car has a balustrade arranged on a roof of the elevator car, wherein the balustrade includes posts, that are attached on a horizontal upper side of the roof, and post-connecting crossmembers. For each post, a docking element is arranged on the upper side of the roof, and the post can be docked on the docking element. The docking element has form-fitting elements in the form of fingers for accommodating the post in a form-fitting manner and the post has slots or apertures, that are complementary to the fingers, the fingers engaging in the slots or the apertures. The docking element is a flattened component made up of two stacked plates and is screwed to the roof. The balustrade is secured by obliquely running supporting profiles extending between the handrail and the roof.

15 Claims, 5 Drawing Sheets

(56) References Cited

U.S. PATENT DOCUMENTS 6,467,230 B1 * 10/2002 Perkins ..... E04F 11/1812 256/65.14
6,540,209 B2 * 4/2003 Ross ..... E04G 21/3233 256/73
6,554,257 B1 * 4/2003 Kenton ..... E04H 17/18 256/65.14
6,679,482 B2 * 1/2004 Allenbaugh ..... E04G 21/3242 248/231.71
7,243,473 B2 * 7/2007 Terrels ..... E04C 3/32 52/843
7,338,033 B2 * 3/2008 Anson ..... E01F 9/692 256/65.01
7,614,819 B1 * 11/2009 Mirman ..... E01F 13/065 40/607.05
7,909,310 B2 * 3/2011 Weiner ..... E04H 12/2215 256/45
2001/0045554 A1 * 11/2001 Pulliam ..... A01K 3/005 256/65.14
2004/0025460 A1 * 2/2004 Terrels ..... E04F 11/1814 52/298
2005/0230194 A1 * 10/2005 Nakamura ..... B66B 5/0081 187/401
2007/0034847 A1 * 2/2007 Shertzer ..... E04H 4/06 256/65.14
2007/0176159 A1 * 8/2007 Schram ..... E01F 13/026 256/65.14
2008/0237560 A1 * 10/2008 Dehlsen ..... E04H 17/22 256/65.14
2011/0017968 A1 * 1/2011 Christoffer ..... E04G 21/3223 256/65.14
2014/0217347 A1 * 8/2014 Green ..... E04F 11/1812 256/65.14
2016/0160900 A1 6/2016 Milanowski
2022/0009744 A1 * 1/2022 Hugel ..... B66B 5/0081

FOREIGN PATENT DOCUMENTS

CN 2611504 Y 4/2004
CN 102817493 A 12/2012
CN 102897617 A 1/2013
CN 103758396 A 4/2014
CN 204080626 U 1/2015
CN 204081317 U 1/2015
CN 205045666 U 2/2016
CN 106006314 A 10/2016
CN 205802724 U 12/2016
CN 106337863 A 1/2017
CN 207092420 U 3/2018
CN 108119445 A 6/2018
CN 108529399 A 9/2018
CN 108557602 A * 9/2018 ..... B66B 5/0081
CN 112047217 A * 12/2020
CN 113277395 A * 8/2021
EP 1764336 A2 3/2007
JP H08310771 A 11/1996
JP 3375455 B2 2/2003
JP 2008213960 A 9/2008
JP 2012206798 A 10/2012
JP 2013237554 A 11/2013
WO 2018095741 A1 5/2018

* cited by examiner

ELEVATOR CAR

FIELD

The invention relates to an elevator car for an elevator having a balustrade arranged on the roof of the elevator car.

BACKGROUND

Elevators contain elevator cars which can be moved up and down in an elevator shaft via suspension means, for example in the form of suspension ropes or suspension belts, by means of a drive unit. For specific situations, such as maintenance work or inspections, it is necessary for people to be on the car roof. If the width of a gap between the elevator car and the adjacent shaft wall is too large, balustrades must be installed on the car roof to prevent falls.

Balustrades on the roof of elevator cars have been known and used for a long time. The balustrades include vertical posts and horizontal post-connecting crossmembers. The crossmembers can have at least one handrail which forms the uppermost crossmember. Central crossmembers, i.e. crossmembers about halfway up the balustrade, are also often used. For example, the ASME AI 7.1-2000 standard for the USA or the European standard EN81-20:2014 contain instructions with detailed specifications for the design and dimensioning of the car roof and the necessary balustrade. The known balustrades are comparatively heavy and expensive. Another disadvantage is that installing the balustrade on the car roof can be complex.

SUMMARY

It is therefore an object of the present invention to avoid the disadvantages of the known elevator car and in particular to create an improved elevator car having a balustrade.

According to the invention, this object is achieved by an elevator car with a balustrade arranged on a roof of the elevator car having posts attached to a horizontal upper side of the roof and post-connecting crossmembers. The balustrade generally has at least one handrail on each side of the elevator car where fall protection is necessary. This handrail forms the uppermost crossmember. Furthermore, further crossmembers such as a central crossmember can be provided below the handrail. For each post, a docking element is arranged on the upper side of the car roof, to which the post is, or can be, docked. The docking element has at least one form-fitting element for accommodating the post in a form-fitting manner and the post has at least one post-form-fitting element that is complementary to the aforementioned form-fitting element. The docking element can be preinstalled on the car roof. Due to the docking elements already placed on the car roof, the correct position of the posts is specified in an efficient manner in terms of location. The docking element and the form-fitting elements allow for a quick and easy installation of the balustrade in just a few work steps. When the post is docked on the associated docking element, a form-fitting connection is created between the post and the car roof in the region of the docking element.

The end face of the post has at least one and preferably at least two open slots. For the at least one slot, the docking element has a complementary finger which engages into the slot or which can be brought into engagement with the slot. If the post has a plurality of slots, the docking element has fingers which are complementary to the slots and which engage in the respective slots or which can be brought into engagement with the respective slots. The fingers form the aforementioned form-fitting elements assigned to the docking element and the slots form the post-form-fitting elements. The fingers or the slots can be cuts in metal structures to create the post or the docking element. For example, by machining methods, such cuts in metal structures can be made easily and precisely.

In an alternative variant, the post has at least one and preferably at least two apertures as post-form-fitting elements. The docking element has a complementary finger to the at least one aperture, which finger engages in the aperture or which can be brought into engagement with the aperture. If the post has a plurality of apertures, the docking element has fingers which are complementary to the apertures and which engage in the respective apertures or which can be brought into engagement with the respective apertures. Compared to the aforementioned variant with the slots, which is characterized by particularly simple installation, the present variant with the apertures is characterized by a particularly stable and reliable form-fit connection.

The posts can be plugged onto or attached to the docking elements. In this way, a simple and quickly achieved plug connection is created. The docking elements can preferably already be preinstalled on the car roof before the posts are plugged in. The plug-in process, which is preferably carried out by a vertical movement of the posts downwards towards the docking elements, can be advantageous in particular in the case of the first variant described above with the fingers and slots.

Furthermore, it can be advantageous if the respective finger of the docking element is formed by a projection extending in the horizontal direction. The finger or fingers are thus arranged on the edge of the docking element and do not increase the overall height of the docking element.

The respective finger can be designed to be rectangular in a plan view. Such a form-fitting element can be manufactured easily and precisely. Instead of fingers that are rectangular in plan view, other shapes with fingers for creating a finger joint would also be possible. For the form-fitting connection of the post and docking element, a web-wedge connection would also be conceivable.

The docking element is particularly advantageously provided with a plurality of fingers on each side intended for the form fit. The docking element can thus have an edge-side profiling created by cuts with rectangular shapes that form a kind of comb structure.

A particularly simple and compact docking element can be created if the docking element is a component made up of one or more plates. For this purpose, metal plates made of steel or another metal material, for example, can be used. This creates a flattened component with a low overall height. The car roof having the preinstalled docking elements attached thereto can thus be transported to the intended location for the elevator system in a space-saving manner.

If the docking element is a component made up from a plurality of plates and preferably in layers, it can be advantageous if there is a docking plate provided with the finger(s) and a spacer plate for spacing or elevating the fingers from the upper side of the roof so that the finger(s) is or are exposed. In this way, a reliable engagement between the finger and the associated slot for a stable form fit can be achieved.

Generally, it is conceivable to fit the docking element with spacer plate and docking plate directly into the upper side of the roof. However, if the upper side of the roof is formed by surface elements in a sandwich construction, for example with a PU (polyurethane) foam core, it can be advantageous if the docking plate and the spacer plate can each rest on a larger base plate. The spacer plate lies between the docking plate and the base plate.

It can also be advantageous if the docking element is screwed to the roof in each case. The dimensions in relation to the plan view of the docking element can correspond approximately to those of the post.

The post can each be an L-profile. A balustrade with such L-shaped posts has the advantage that the balustrade is particularly light. On both legs of the L-profile, a plurality of slots can be provided on the end face. The associated docking element can be designed to be rectangular and in particular square in plan view, two sides of the rectangle facing the "L" being provided with a plurality of fingers in each case.

For a stable balustrade, it can be advantageous if it is secured by means of obliquely running supporting profiles for reinforcement. An upper anchoring point for the respective supporting profile can be located at the handrail of the balustrade and a lower anchoring point for the respective supporting profile on the upper side of the roof. The respective supporting profile can be connected to a post at the level of the handrail. However, the respective supporting profile can also be connected to the handrail, preferably in the vicinity of the post. The lower anchoring point for the respective supporting profile can preferably lie in the region of an adjacent roof edge so that the supporting profile connecting the upper anchoring point with the lower anchoring point is arranged outside the accessible upper side of the roof. The respective supporting profile can thus be connected to the post directly or indirectly (via the handrail).

Such supporting profiles could also be advantageous for balustrades of elevator cars having docking elements without fingers and without slots or apertures assigned to the posts which interact with the fingers to create the form fit. In other words, these supporting profiles could also be used in an elevator car which has a balustrade arranged on the roof of the elevator car, the balustrade comprising posts attached to a horizontal upper side of the roof and post-connecting crossmembers. For each post, a docking element is arranged on the upper side of the roof, to which the post is, or can be, docked, the docking element having at least one form-fitting element for accommodating the post in a form-fitting manner and the post having at least one post-form-fitting element complementary to the aforementioned form-fitting element.

A roof profile arranged outside the accessible region of the upper side of the roof can be attached to the roof of the elevator car. This outer region of the upper side of the roof is a region of the upper side of the roof facing the adjacent shaft wall, starting from the balustrade as a separating part. In other words, the roof profile is arranged to be offset from the balustrade in relation to the handrail on the upper side of the roof. The roof profile can be positioned directly on the roof edge and have a side wall portion which is flush with the car side wall. It is advantageous if the aforementioned supporting profile is connected in each case to the roof profile described herein.

The respective supporting profile can be connected to the roof profile on one side and/or to the post or the handrail on the other side by means of T-shaped connecting elements, preferably designed as a bent part made of metal.

DESCRIPTION OF THE DRAWINGS

Further individual features and advantages of the invention are derived from the following description of an embodiment and from the drawings. In the drawings.

DETAILED DESCRIPTION

Figure 1:
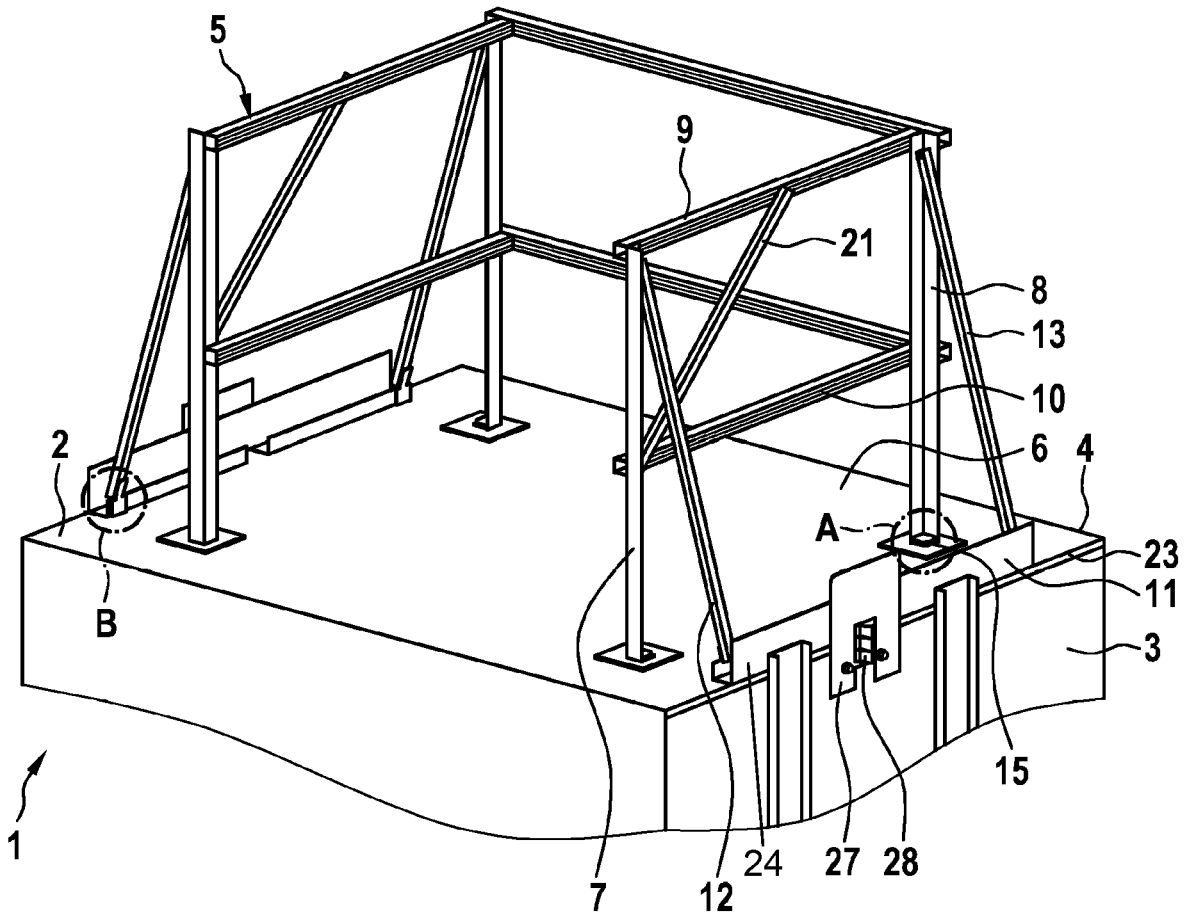
FIG. 1 is a perspective view of a roof of an elevator car having a balustrade according to the invention.

FIG. 1 shows an elevator car for an elevator in a building, which elevator car is denoted by reference sign 1. The elevator car 1, which can be moved vertically up and down, is used to transport passengers or goods. The movement of the elevator car 1 takes place, for example, via suspension means (not shown) which carry the elevator car 1, for example in the form of a loop. A drive unit (not shown) is positioned in the region of the shaft head to move the elevator car. The elevator car 1 could of course also be used for elevator systems with machine rooms.

The elevator car 1 has a car body with a floor (not shown), side walls 3, a rear side 4, one or two elevator doors (also not shown) and a roof 2. A balustrade 5 is arranged on the roof 2 of the elevator car 1, which balustrade forms a fall protection with respect to three sides of the elevator car 1. In the region of a front side in which the elevator car 1 is equipped with a car door, no fencing is necessary because of the small gap between the elevator car and the shaft wall.

The balustrade 5 comprises a total of four vertical posts 7, 8. In each case, two posts are connected to one another with two crossmembers 9, 10 in each case, an uppermost crossmember being a handrail 9 and a central crossmember 10 being arranged as a second crossmember at approximately mid-height. The posts 7, 8 are connected in a form-fitting manner to docking elements 15 fastened to the upper side of the roof. This form-fitting connection represents a particular aspect of the invention and is described in detail below (see in particular the following FIGS. 2A, 2B). The balustrade 5 also has four obliquely running supporting profiles 12, 13, which secure the balustrade and ensure sufficient stability.

Roof profiles 11 are arranged on the roof edge 23. On each side wall 3 of the elevator car 1, a carrier plate 27 is fastened at the upper side, which carrier plate protrudes beyond the roof edge 23 and is fixed both to the respective side wall 3 and to the roof profile 11. In the present case, a sliding guide shoe 28 for guiding the elevator car is attached to the carrier plate 27 by way of example. As an alternative to the sliding guide shoe, a roller guide shoe would of course also be conceivable. In addition to the guide arrangement, further elevator components (not shown) can also be attached to the carrier plate 27. The roof profile 11 is positioned directly on the roof edge and has a side wall portion 24 which is flush with the car side wall 3.

For each post 7, 8, a docking element 15 is arranged on the horizontal upper side 6 of the roof. The docking element 15 has form-fitting elements for accommodating the post 8 in a form-fitting manner. These form-fitting elements can be seen in FIG. 2A. The form-fitting elements are formed by fingers 16. The docking element 15 has a rectangular design in plan view and has three fingers 16 on each of two sides of the rectangle. The counterpart to the fingers is formed by slots 17 which are arranged on the end face of the post 8. The respective post 7, 8 is clearly designed as an L-profile. Three slots 17 are assigned to each leg of the "L". The slots form post-form-fitting elements that are complementary to the fingers 16.

The slots 17 and the fingers 16 are dimensioned and matched to one another in such a way that a fit with little play is created during assembly. Because of the small amount of play, it may be necessary that when the post is docked, in which case the post is moved vertically downwards, the post must also be knocked in with a hammer, so that, thanks to the additional frictional connection, a particularly reliable and strong connection between the posts and the car roof is created. Obviously, this type of connection corresponds to a plug connection. In other words, the posts 7, 8 can be plugged onto the docking elements 15 or inserted into the docking elements 15 after the docking process has ended. The slots 17 can be created simply by making cuts in the structure for the post 8.

The docking element is a flattened component made up of two plates 18, 19 and having a rectangular basic shape. The plates 18, 19 are clearly stacked on top of one another, resulting in a flattened component made up in layers. If an L-profile with two identical legs is used for the post 7, 8, the docking element 15 has an approximately square plan in plan view. The upper plate 18 is provided with the fingers 16, which is why it is also referred to below as the docking plate. The lower plate 19 is a spacer plate for spacing the fingers 16 from the upper side of the roof. The fingers 16 are raised from the upper side of the roof, so that the fingers 16 are on display and the docking can be ensured in a reliable manner. The docking element 15 is fastened to the car roof 2 via a screw connection. A corresponding screw of the screw connection can be seen in this drawing and is designated by the reference sign 22.

The respective form-fit portions of the docking plate 18 define an "L" shape in plan view. Thanks to the new connection method, in which posts are docked into docking elements in a form-fitting manner, sheet metal profiles having different thicknesses can also be attached to the car roof without welding or other additional fasteners such as bolts, screw connections, or adhesive processes.

The fingers 16 of the docking element 15 are formed by a projection extending in the horizontal direction. The respective finger 16 is designed to be rectangular in a plan view.

Figure 2A:
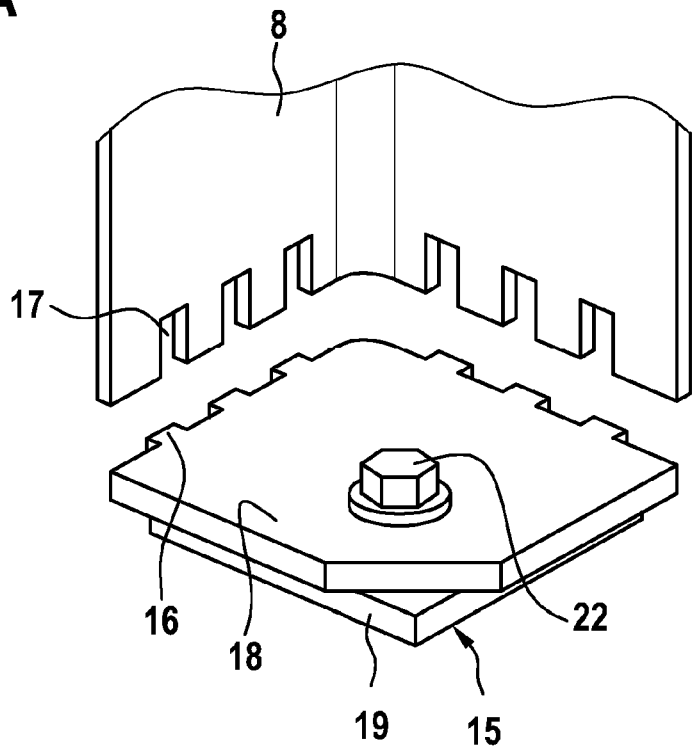
FIG. 2A is an enlarged perspective view of a docking element and a not yet docked post of the balustrade from FIG. 1.
Figure 2B:
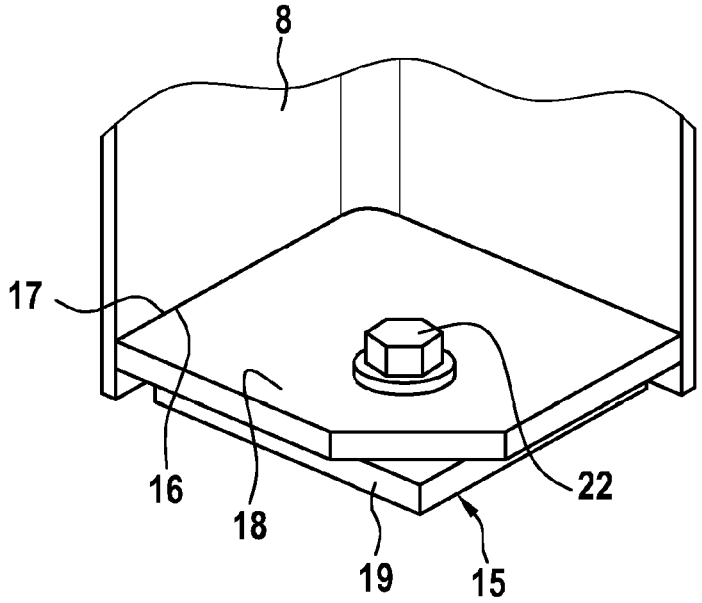
FIG. 2B is an enlarged perspective detail view of a docking element and a post accommodated by this docking element (detail A from FIG. 1)

FIG. 2B shows the assembled post 8 after the end of the docking process. FIG. 2B corresponds to an enlarged illustration of detail A from FIG. 1 for the post in the corner region between the side wall 3 and the rear side 4. This post, denoted by the reference sign 8, is consequently a rear post of the balustrade 5. The front posts 7 and the associated docking elements, to which the post 7 is docked, are designed in the same way.

The docking element 15 thus has form-fitting elements in the form of fingers 16 for accommodating the post in a form-fitting manner; the post 7, 8 has slots 17 as post-form-fitting elements, which are complementary to the fingers 16, the latter engaging in the slots 17. This allows the posts 7, 8 to be easily docked to the docking element 15 assigned to the upper side of the elevator car, as a result of which the posts 7, 8 can be installed quickly and in a few steps onto the car roof 2.

Figure 3:
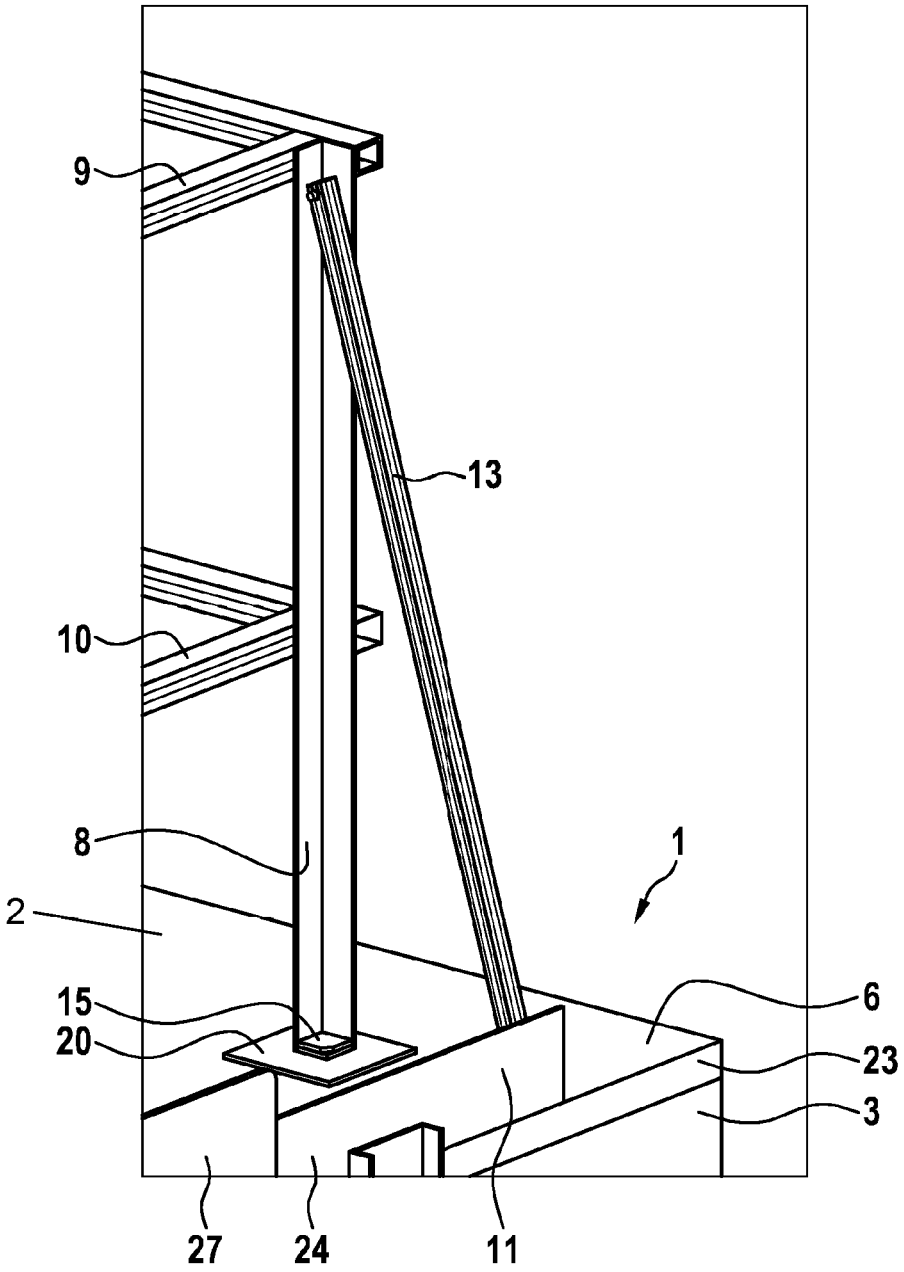
FIG. 3 is a view of a corner region of the balustrade in a slightly enlarged perspective illustration.

Further structural details of the balustrade 5 are shown in FIG. 3. From this, it can be easily seen that the crossmembers 9, 10 are each designed as C-profiles. Of course, other profile shapes, such as closed box profiles, would also be conceivable. The supporting profiles 12, 13 are also formed by C-profiles.

The car roof 2 can comprise a steel sheet which forms the horizontal upper side of the roof. But it is also conceivable to use surface elements in sandwich construction for the car roof. For example, the car roof could be formed by a sandwich element with a PU foam. For roofs 2 having such surface elements in sandwich construction, it may be necessary to use a sufficiently thick metal base plate on the upper side of the roof to accommodate a docking element 15; FIG. 3 shows a base plate of this type which is designated by the reference sign 20.

Figure 4:
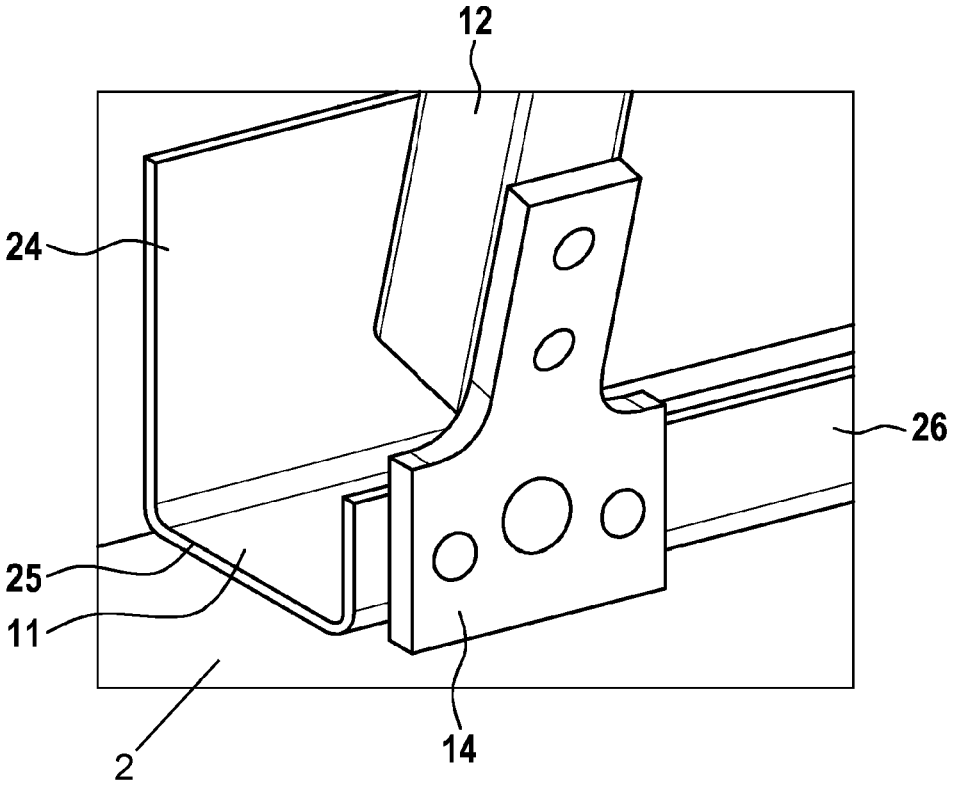
FIG. 4 is an enlarged illustration of the detail B from FIG. 1.

FIG. 4 shows the interface between the supporting profile 12 and the car roof 2 in a large view of detail B from FIG. 1. The supporting profile 12 is connected to the roof profile 11 by means of a T shaped connection element 14. The connecting element 14 is designed as a bent part made of metal, as a result of which the connecting element can be produced simply and inexpensively and, depending on the inclination of the supporting profile, can be adapted to various circumstances and elevator car designs. The connection element is preferably fixed to the respective components by means of screw connections, which are not shown in this case for the sake of simplicity. In contrast, drilled holes through which screws can be passed can be seen in FIG. 4. The type of connection explained in this case using the T-shaped connecting element 14 is also used for the upper anchoring points. The rear supporting profiles 13 are connected directly to the posts 8 by means of similar T-shaped connecting elements. In the region of the front side, the respective T-shaped connecting elements are screwed to the handrail 9.

In addition to the already mentioned side wall portion 24, the roof profile 11 has a bottom portion 25 and a short side wall portion 26. The connecting element 14 abuts flat against the side wall portion 26 and is connected to the roof profile 11 by means of screws (not shown) in the region of the side wall portion 26.

The oblique supporting profiles 12 and 13 guide horizontal forces acting on the handrail 9 in the car width into the car roof 2. This allows for little or no bending torques to act on the respective posts 7, 8. It can be seen that the oblique supporting profiles 12, 13 each lie in vertical planes running at right angles to the associated handrail 9. Thanks to the supporting elements 12, 13, comparatively light and thin structures can be created for the form-fitting connection between the post and the docking element. If the supporting profiles 12, 13 were to be dispensed with, the connection in question would have to be designed to be stronger and, accordingly, a significantly greater amount of material would have to be provided for this purpose.

Figure 5A:
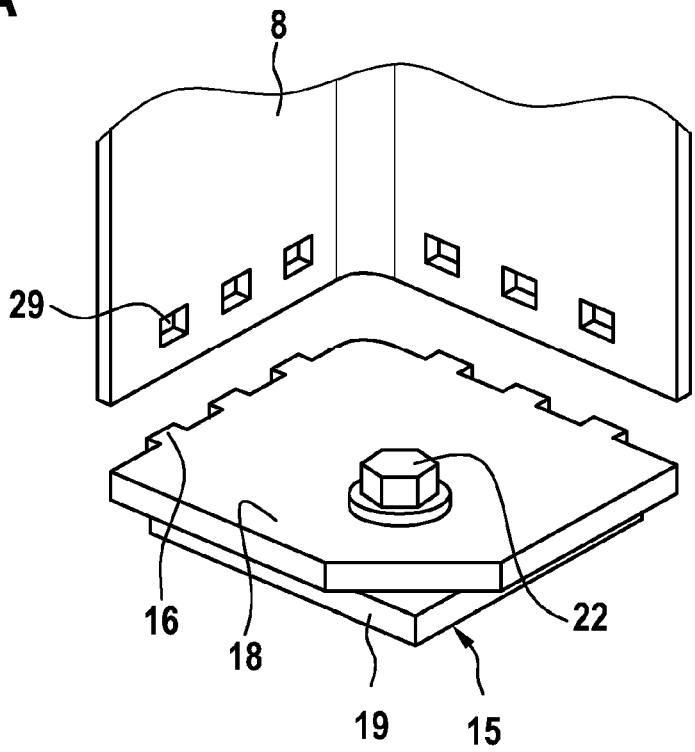
FIG. 5A shows a docking element and a not yet docked post according to an alternative embodiment to FIG. 2A.
Figure 5B:
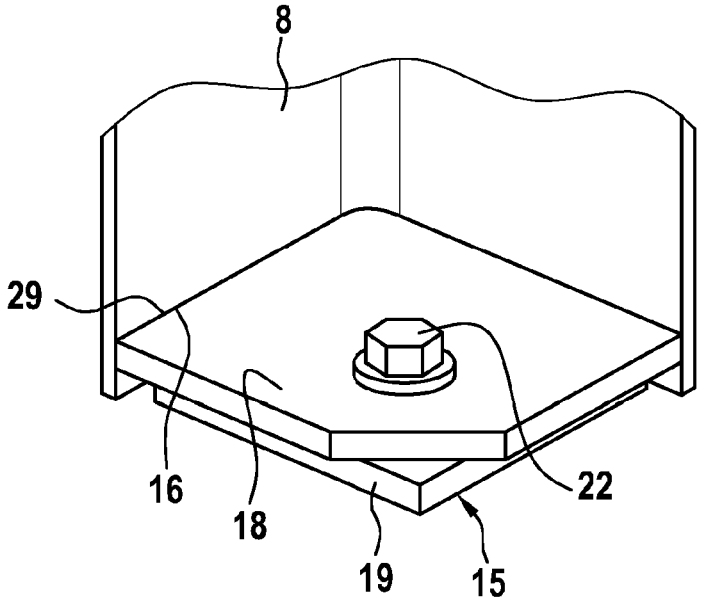
FIG. 5B shows the docking element and the post after the docking process is complete.

Instead of the slots 17 open on the end face shown in FIG. 2A, apertures could also be provided in the post. FIGS. 5A, 5*b* show such an alternative variant of a form-fitting connection between the post 8 and the docking element 15. The post 8 comprises apertures 29 on the end face. Three rectangular apertures 29 are assigned to each leg of the "L" of the profile for the post 8. The apertures 29 are adapted to the fingers 16 of the docking element 15 in terms of position and dimensions. For simple installation, it can be advantageous if the width of the apertures 29 is chosen to be sufficiently large compared to the finger widths. The width is the dimension of the aperture 29 with respect to the horizontal.

For example, if the width of the finger 16 is 5 mm, the aperture 29 can be 6 mm wide.

A person skilled in the art recognizes that the previously described and shown features can be combined, adapted, or replaced as appropriate in order to arrive at further embodiments of the invention.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator car having a balustrade arranged on a roof of the elevator car, the balustrade including a plurality of posts attached on a horizontal upper side of the roof and crossmembers connecting the posts, the elevator car comprising:

a plurality of docking elements arranged on the upper side of the roof, each of the docking elements having an associated one of the posts docked thereon;

each of the docking elements having at least one form-fitting element accommodating the post and the associated post having at least one post-form-fitting element complementary to the at least one form-fitting element;

wherein the at least one post-form-fitting element is an open slot or an aperture formed at an end face of the each of the posts; and wherein the at least one form-fitting element of each of the docking elements is a finger complementary to the open slot or the aperture and the fingers of the docking elements engage in the slots or the apertures of the associated posts when the posts are docked on the docking elements.

2. The elevator car according to claim 1 wherein the posts are adapted to be plugged onto the docking elements.

3. The elevator car according to claim 1 wherein the fingers of the docking elements are formed by a projection extending in a horizontal direction parallel to the upper side of the roof.

4. The elevator car according to claim 3 wherein the fingers are formed in a rectangular shape in a plan view.

5. The elevator car according to claim 1 wherein each of the docking elements is a flattened component made up of at least one plate.

6. The elevator car according to claim 5 wherein the at least one plate is a docking plate provided with the at least one finger and each of the docking elements includes a spacer plate spacing the at least one finger from the upper side of the roof to expose the at least one finger.

7. The elevator car according to claim 1 wherein each of the docking elements is fastened to the roof by a screw.

8. The elevator car according to claim 1 wherein each of the posts is formed with an L-profile.

9. The elevator car according to claim 1 wherein the balustrade is secured to the roof by a plurality of obliquely running supporting profiles.

10. The elevator car according to claim 9 wherein for each of the supporting profiles an associated upper anchoring point is located on a handrail of the balustrade and an associated lower anchoring point is located on the upper side of the roof adjacent a roof edge of the roof, and wherein the supporting profiles extend between the associated anchoring points and are arranged outside an accessible region of the upper side of the roof, the accessible region being within the balustrade.

11. The elevator car according to claim 9 including a roof profile arranged outside an accessible region of the upper side of the roof, the accessible region being within the balustrade, the roof profile being attached on the roof and at least one of the supporting profiles is connected to the roof profile.

12. The elevator car according to claim 11 including T-shaped connecting elements connecting the supporting profiles to at least one of the roof profile, one of the posts and the handrail.

13. The elevator car according to claim 12 wherein the T-shaped connecting elements are bent parts formed of a metal material.

14. An elevator car having a balustrade arranged on a roof of the elevator car, the balustrade including a plurality of posts attached on a horizontal upper side of the roof and crossmembers connecting the posts, the elevator car comprising:

a plurality of docking elements arranged on the upper side of the roof, each of the docking elements having an associated one of the posts docked thereon;

each of the docking elements having at least one form-fitting element accommodating the post and the associated post having at least one post-form-fitting element complementary to the at least one form-fitting element;

wherein the at least one post-form-fitting element is an open slot or an aperture formed at an end face of the each of the posts, the open slot having an open end at the post end face and an opposite closed end; and wherein the at least one form-fitting element of each of the docking elements is a finger complementary to the open slot or the aperture and each of the slots or the apertures engages only one of the fingers when the posts are docked on the docking elements.

15. An elevator car having a balustrade arranged on a roof of the elevator car, the balustrade including a plurality of posts attached on a horizontal upper side of the roof and crossmembers connecting the posts, the elevator car comprising:

a plurality of docking elements arranged on the upper side of the roof, each of the docking elements having an associated one of the posts docked thereon, wherein the posts are adapted to be plugged onto the docking elements;

each of the docking elements having at least one form-fitting element accommodating the post and the associated post having at least one post-form-fitting element complementary to the at least one form-fitting element;

wherein the at least one post-form-fitting element is an open slot or an aperture formed at an end face of the each of the posts, the open slot having an open end at the post end face and an opposite closed end;

wherein each of the docking elements includes a docking plate extending in a horizontal plane spaced from and parallel to the upper side of the roof; and wherein the at least one form-fitting element of each of the docking plates is a finger projecting from the docking plate in the horizontal plane and being complementary to the open slot or the aperture, and each of the slots or the apertures engages only one of the fingers when the posts are docked on the docking elements.

* * * * *